US012582151B2

(12) United States Patent
Maurutto

(10) Patent No.: US 12,582,151 B2
(45) Date of Patent: Mar. 24, 2026

(54) METHOD AND PLANT FOR TREATING TOBACCO LEAVES

(71) Applicant: COMAS-COSTRUZIONI MACCHINE SPECIALI-S.P.A., Silea (IT)

(72) Inventor: Roberto Maurutto, Silea (IT)

(73) Assignee: COMAS—COSTRUZIONI MACCHINE SPECIALI—S.P.A, Silea (IT)

( * ) Notice: Subject to any disclaimer, the term of this patent is extended or adjusted under 35 U.S.C. 154(b) by 519 days.

(21) Appl. No.: 18/024,441

(22) PCT Filed: Sep. 3, 2021

(86) PCT No.: PCT/IB2021/058055
§ 371 (c)(1),
(2) Date: Mar. 2, 2023

(87) PCT Pub. No.: WO2022/049530
PCT Pub. Date: Mar. 10, 2022

(65) Prior Publication Data

US 2023/0255255 A1 Aug. 17, 2023

(30) Foreign Application Priority Data

Sep. 4, 2020 (IT) ..... 102020000021067

(51) Int. Cl.
*A24B 5/00* (2006.01)
*A24B 5/06* (2006.01)

(52) U.S. Cl.
CPC ..... *A24B 5/06* (2013.01)

(58) Field of Classification Search
CPC .... A24B 5/00; A24B 5/04; A24B 5/06; A24B 5/08; A24B 5/12
See application file for complete search history.

(56) References Cited

U.S. PATENT DOCUMENTS 4,566,470 A 1/1986 Brackmann

FOREIGN PATENT DOCUMENTS

| | | | |
|---|---|---|---|
| CN | 1671477 | A | 9/2005 |
| CN | 104957759 | A | 10/2015 |
| DE | 240537 | C | 7/1909 |
| WO | 2019130444 | A1 | 7/2019 |

OTHER PUBLICATIONS

Brazil Office Action dated Sep. 3, 2021 from counterpart Brazilian App No. BR112023003969-0.

*Primary Examiner* — Eric Yaary
(74) *Attorney, Agent, or Firm* — SHUTTLEWORTH & INGERSOLL, PLC; Timothy J. Klima

(57) ABSTRACT

A method of treating tobacco leaves for separating the lamina from rib, includes:

collecting the leaves in mannochi, and subjecting them to a shredder, where portions of the lamina of each leaf are torn from the remaining part of the leaf, separating portions of lamina from the remaining part of the leaf, by air, in at least one classification chamber, directly transferring portions of torn lamina to subsequent drying and packaging processes, passing the remaining parts of the leaf through a multi-stage beating line, in each of which progressive separation of portions of the lamina from the remaining part of the leaf is caused or to obtain at the exit of said beating line, an almost total separation of the lamina from the rib, transferring the separated portions of lamina to subsequent drying and packaging processes, transferring the pieces of rib exiting the beating line to the packaging.

9 Claims, 2 Drawing Sheets

METHOD AND PLANT FOR TREATING TOBACCO LEAVES

FIELD OF THE INVENTION

The present invention relates to a tobacco leaf treatment method and plant.

BACKGROUND

Methods for processing tobacco leaves are known, and in particular methods which provide for treating the tobacco leaves in order to separate their most valuable parts (lamina) from the least valuable parts (rib).

Generally the tobacco leaves that are detached from the plants have dimensions between 300 mm and 1000 mm and are collected in bunches or "mannocchi", which have a weight of about 1 kg and are made up of 8-10 leaves held together by one of these wrapped around the others. The mannocchi are then collected together in groups of 40-50 to form the so-called "ballotti", which are then introduced into jute bags or cardboard boxes to be sent for subsequent processing, of which the one of interest here is the separation of the lamina from the rib.

Various separation techniques are known and one of these provides that the bales are treated in a pre-sorting line, in which they are placed on supply benches, where there are operators who take care of picking up the single mannocchi of each baling and arrange them on a conveyor belt, so that the tips of the leaves are oriented towards the longitudinal axis of the belt, in order to be then cut and separated by means of a pair of rotating knives placed at the downstream end of this feeding belt.

The purpose of this preliminary separation of the tips from the remaining part of the leaves is to preliminarily remove the parts of the leaf without the rib, which constitute 22-25% of the leaf itself and do not require to be subjected to an unnecessary treatment of separation of the lamina from the rib, which is required instead by the remaining part of the leaf.

Again this known method of treating tobacco leaves provides that the leaves thus deprived of the tip and any ties are subjected to a first vacuum conditioning cycle for about 20 minutes in a vacuum chamber, in which two or more cycles of vacuum with steam injection at each cycle, in order to increase the percentage of humidity from 8-10% to about 14-16% and thus make the product much more flexible and therefore less fragile and more resistant in the following phases of manipulation and mechanical processing. These injections also have the function of carrying out a partial sterilization of the tobacco leaves.

It is then envisaged that the conditioned product is placed on sorting belts, where other operators eliminate the leaves that do not comply with the required standards, before conveying the remaining leaves to mixing silos, where provided, or to a second conditioning cycle similar to the previous one.

The leaves that come out of the second conditioning cycle are then transferred to a threshing line to undergo a series of beating cycles, each of which involves "beating" the leaves with a sort of "knives", so as to cause the detachment of parts of the lamina of the leaf from the rib. Moreover, since it is unthinkable that this occurs in a single treatment phase, it is generally envisaged that the beating line includes several beating stages, generally from three to five, each alternating with grading stages in classification chambers: at each beating stage knives which act on the leaves are arranged closer and closer to each other and, after beating, drop the pieces obtained on an underlying perforated grid with holes of different design according to the beating stage. The product that comes out of each stage is transferred to a classification chamber, where a blow of air introduced from the bottom upwards separates the lighter pieces of lamina from the heavier rib pieces and sends the first to a collection line for transfer to a packing station for subsequent uses; the heavier pieces of rib, to which pieces of lamina are still attached, are transferred to the next beating stage for further separation of other lamina, and so on until all the lamina is removed from the rib, which represents generally a percentage of about 22% of the whole leaf and is sent to a rib packing station.

The efficiency of a traditional beating line is evaluated based on the percentage of lamina extracted from each grading chamber.

As an example, and with reference to international parameters (see CORESTA) in a beating line with five stages, and considering an average percentage of leaf limb or lamina equal to 78% and rib equal to 22%, one can think to extract 50.7% in the first beating stage, 17.16% in the second stage, 6.24% in the third stage, 2.34% in the fourth stage and 1.56% in the fifth stage, for a total of 78%.

From this brief exposition of the state of the art it is possible to understand the limits and drawbacks that it entails.

A first drawback consists in the large number of operators that a tobacco leaf treatment line of the type just described requires.

In particular, these operators are located in the pre-sorting line, in which the mannocchi or single tobacco leaves are placed, and in the sorting line, from which the leaves that do not conform to the required standards are removed.

Taking into account that an operator is generally able to feed 400-500 Kg/h of product and that a treatment plant is able to process 8,000-10,000 Kg/h of product, it follows that this plant must be able to count on the simultaneous presence of at least 30-40 people.

Another drawback consists in the fact that these operators, and in particular those assigned to the pre-sorting line, are forced to work in unhealthy environmental conditions, as the high quantity of dust, which is released during the handling of the mannocchi or single leaves, cannot be completely removed from the suction devices provided in the work environment.

Another drawback consists in the fact that the various stages of the beating line involve a high consumption of electrical energy, which significantly affects the final cost of the product.

Another drawback consists in the fact that the beating line involves large dimensions.

In order to reduce these drawbacks, it has already been proposed to eliminate the pre-sorting line and to place the tobacco leaf mannocchi directly on conveyor belts which feed the first conditioning cylinder. However, if on the one hand this technique has made it possible to eliminate the operators involved in the pre-sorting line and the encumbrances that this entails, on the other hand it has made the work of the beating line heavier, since it has also subjected the tips of the tobacco leaves, which would not require it and which could have been sent directly to the packaging.

Furthermore, this technique has not eliminated the other drawbacks indicated above.

A method of treating tobacco leaves is also known from U.S. Pat. No. 4,566,470, which provides for placing the individual tobacco leaves oriented longitudinally on a feed line of a first cutter which cuts them into strips of such a width as to allow their subsequent cutting transversal with a second cutter into strips that can be used directly in a cigarette packing machine.

The strips of tobacco leaves that come out of the first cutter are fed to a first air classification chamber, which separates the portions of lamina only, which are lighter and are fed directly to the second cutter, from the lamina portions still attached to rib portions, which are heavier and are fed to a beating machine (Thresher). This detaches the lamina portions from the rib portions and feeds the whole to a second air classification chamber, in which the separation of the lamina portions from the rib portions takes place. The former are sent to the second cutter, while the latter are fed to a shredder, from which the rib fragments are mixed with the strips of lamina coming out of the second cutter to then feed the cigarette packaging machine.

A drawback of this known technique consists in the fact that it requires manually dissolving the mannocchi and feeding the individual tobacco leaves in an oriented manner, that is, aligned with the direction of feeding.

Another drawback, a consequence of the previous one, consists in the fact that the entire treatment of the tobacco leaves requires a large number of operators, with the inevitable high cost of the treatment itself.

Another drawback of this known technique consists in the fact that it does not allow the individual leaves to be cut on a regular basis and consequently requires the product to be subjected to repeated processing steps to be brought to the homogeneous conditions required for the packaging of cigarettes.

SUMMARY

The object of the present invention is to eliminate or at least significantly reduce these drawbacks as well.

In particular, the object of the invention is to drastically reduce the personnel assigned to handling the tobacco leaves.

Another object of the invention is to reduce the energy consumption of the apparatuses that carry out that treatment on the tobacco leaves.

Another object of the invention is to reduce the pollution due to the release of dust in the work areas.

Another object of the invention is to reduce the bulk of the treatment plant and in particular of the beating line.

Another object of the invention is to propose a plant for the treatment of tobacco leaves which achieves all the purposes indicated above.

Another object of the invention is to propose a plant which achieves all those purposes without reducing the operating potential of the plant itself.

All these objects are jointly or separately achieved according to the invention with a tobacco leaf treatment method and with a treatment plant as defined in the appended claims.

BRIEF DESCRIPTION OF THE DRAWINGS

The present invention is further clarified hereinafter in some its preferred embodiments, reported for purely illustrative and non-limiting purposes with reference to the attached drawings, in which.

DETAILED DESCRIPTION OF THE PREFERRED EMBODIMENTS

Figure 1:
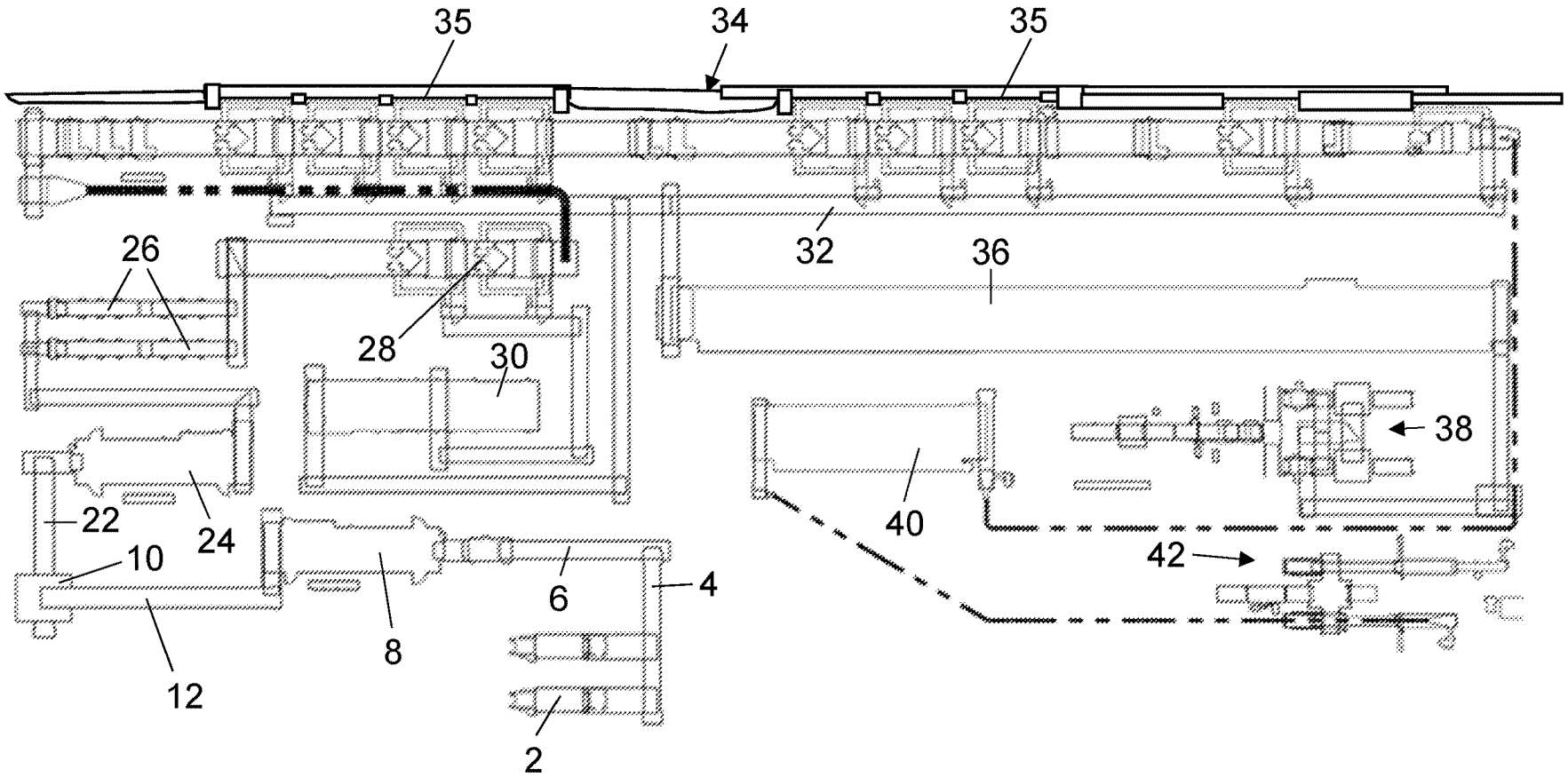
FIG. 1 shows a general schematic view of a tobacco leaf treatment plant according to the invention.
Figure 2:
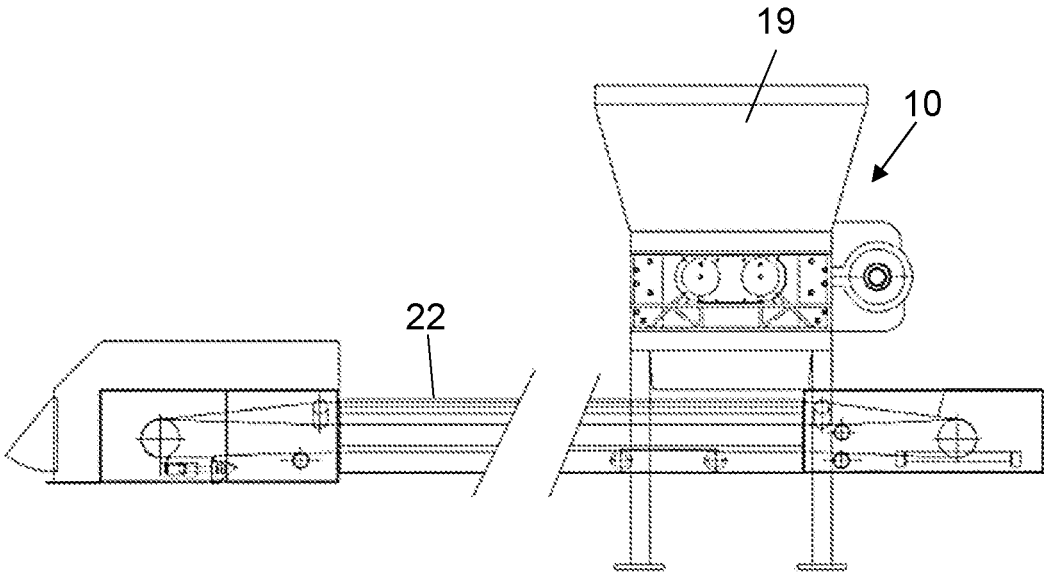
FIG. 2 shows a side view of the disruptor of the plant.
Figure 3:
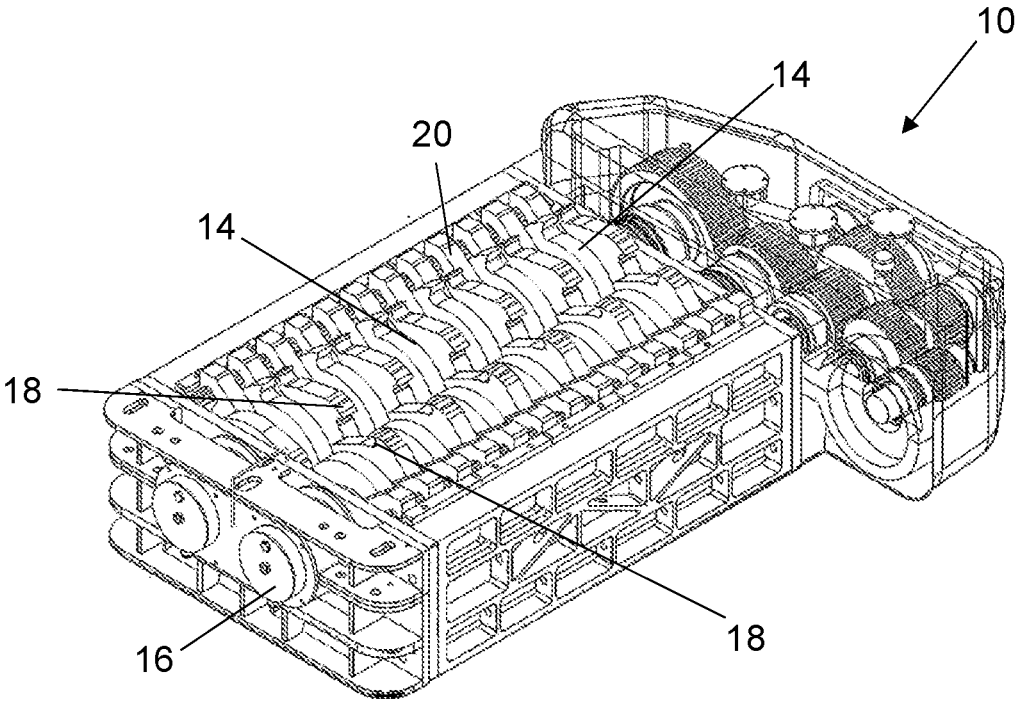
FIG. 3 shows a perspective view of the detail of the operating unit of the disruptor.

As can be seen from the figures, the tobacco leaf treatment plant according to the invention comprises one or more supply benches 2, in which the tobacco leaf mannocchi to be treated are placed.

From these benches 2 the mannocchi are transferred by means of conveyor belts 4,6 to a first rotating conditioning cylinder 8, fed with jets of water and steam and subjected to the recirculation of air to increase the humidity of the tobacco leaves and bring them to a value of about 14-16%, which represents an optimal value to make them more flexible and therefore more suitable for subsequent treatments, to which they must be subjected.

This first conditioning rotating cylinder 8 is traditional in itself and is not further described in its details.

Since then the degree of humidity of the tobacco leaves to be treated can vary according to the country of production and the treatments to which they have been subjected previously, as well as the environmental conditions to which they were preserved before being subjected to this treatment, it may happen that they already have the optimal degree of humidity and that this first conditioning is not necessary. In this case the first conditioning cylinder 8, even if illustrated in the drawing, may not be present and the tobacco leaves can be directly transferred from the conveyor belt 6 to a disruptor 10 (Shredder).

In the example described here, the first conditioner 8 is provided and the conditioned leaves that come out of it are transferred by means of a conveyor belt 12 to the disintegrator 10.

The disintegrator 10 comprises an operating unit with two rotors, each formed by a plurality of shaped discs 14, mounted on a shaft 16, and spaced apart to an extent just greater than their thickness, so as to be able to partially penetrate with the discs 14 mounted on the other shaft 16. They have a shaped profile which highlights along their circumference of the teeth 18, hook-shaped and cooperating with corresponding teeth 18 present in the discs 14 mounted on the other shaft 16 and partially interpenetrating.

The discs are preferably between 5 and 25 in number per linear meter of length of the shaft 16 which supports them and therefore each disc 14 has a thickness of between 40 mm and 200 mm. Furthermore, each disc 14 can have a diameter between 200 mm and 600 mm and can have from 2 to 10 teeth, which can preferably have a height between 30 mm and 50 mm.

The two shafts 16 are associated with distinct motors or distinct transmission systems driven by the same motor; in any case, the two rotors are driven at the same peripheral speed but in opposite directions and are cyclically commanded to reverse their direction of rotation for the reasons which will become clear later.

In the position above the operating unit formed by the two rotors with the shaped discs 14 there is a hopper 19 for loading the tobacco leaves to be treated and the two opposite longitudinal walls of this hopper extend below in comb elements 20 with inclined teeth and partially interpenetrating with the teeth 14 of the respective rotor in order to favor the conveyance of the tobacco leaves towards the rotor itself.

The operating unit of the disruptor 10 is placed on a conveyor belt 22 which feeds the disintegrated material to a second conditioning rotating cylinder 24, similar to the first cylinder 8.

This second conditioning cylinder 24 can preferably unload the product onto one or more benches 26, from which the product can be sent to first grading chambers 28, in which the free sheet parts are sent to a collection silo 30 and from this to a sheet collection line 32, while the rib parts, to which parts of the lamina are still joined, can be transferred to a traditional multi-stage beating line 34, alternating with grading chambers 35 for the complete separation of the lamina portions from the rib portions of the tobacco leaves.

The plant is completed by a lamina drying unit 36, a dried lamina packing station 38, a rib drying unit 40 and a dried rib packaging line 42.

The operation of the system described above is as follows:

the tobacco leaf mannocchi to be treated are placed on the feeding benches 2 and from there they are transferred by means of the feeding belts 4,6 to the first conditioning rotating cylinder 8, in which they are brought to the optimum moisture content before being transferred to the disruptor 10.

Here the bunches of tobacco leaves are subjected to the action of the counter-rotating discs 14, which with their teeth 18 break up the leaves and tear from these strips of lamina having the rough shape of "squares" with dimensions linked to the thickness of the discs themselves, to the shape of the teeth 18 and to the extent of interpenetration between the discs that form the two rotors; indicatively, the squares obtained can have dimensions of about 50 mm×100 mm.

This operation already leads to a separation of about 40% of the lamina from the remaining part of the leaf and this requires to subject only the remaining 60% of the product to beating, with considerable advantages both in the number of stages of the beating line and in the overall dimensions. of the equipment envisaged therein, and finally in the consumption of electricity.

This 60% of product on which the separation of the lamina from the rib of the tobacco leaves is carried out is treated in the various stages of the beating line 34 in the traditional way, in the sense that in the classification chambers 35 located downstream of each beating stage it takes place the separation of the lamina (which is discharged into the lamina collection line 32, already fed with 40% of foils generated in the disruptor 10 and separated from the remaining part of the product in the classification chamber 28) from the remaining part of the product (which is started at the next typing stage).

At the outlet of the beating line 34, therefore, only pieces of ribs are obtained, which are transferred to the drying unit 40 and from this to the packaging station 42, while the foils collected in all the various separation stages are transferred to the drying unit 36 and from this to the packing station 38.

Finally, the dried and packaged sheets and ribs can be transferred to subsequent processing.

From the aforegoing it is evident that the processing of tobacco leaves process according to the invention is greatly advantageous because:

allows to eliminate all the personnel to pre-sorting of tobacco leaves and in particular approximately 50% of all personnel, with the same potential of the plant, eliminates all the dangers to personnel connected with the separation of the leaves that form the mannocchi and with the inevitable release of large quantities of dust, reduces the quantity of product to be subjected to beating with consequent reduction of at least 30% of the electrical energy absorbed by the beating line, it reduces the dimensions of the beating line to an extent that can be estimated up to 40%, it allows to obtain a product with a regular shape, with which to feed the packaging machines of cigarettes.

The invention claimed is:

1. A method of treating tobacco leaves for separation of leaf portions constituting lamina from leaf portions constituting ribs, comprising:

placing bunches of leaves randomly on a feeding line of a shredder, in which flaps of the leaves are torn from a remaining part of the leaves, starting from edges thereof, separating with air in at least one classification chamber the flaps torn from the leaves in said shredder to form first flap portions of predominantly sole lamina and second flap portions of lamina attached to portions of rib, transferring said first flap portions directly to drying and packaging processes, passing the second flap portions through a line of beating in several stages, in each of which a progressive separation of portions of the lamina from remaining portions of lamina attached to portions of rib is caused, to obtain at an exit of said beating line an almost total separation of the lamina from the rib of the leaves, transferring the portions of lamina progressively separated from the portions of rib to the drying and packaging processes, and transferring the pieces of rib exiting the beating line to a further packaging process.

2. The method according to claim 1, wherein at least 30% of the lamina is removed by said shredder.

3. The method according to claim 1, wherein the tobacco leaves in said shredder are subjected to an action of a plurality of counter-rotating shaped discs at a same peripheral speed, partially interpenetrating and provided with teeth acting.

4. The method according to claim 3, wherein said shaped discs of said shredder are subjected to cyclic inversions of their direction of rotation.

5. The method according to claim 1, wherein the flaps exiting said shredder are subjected to a conditioning treatment to bring a moisture content of said flaps to an optimum humidity value for subsequent typing treatments.

6. The method according to claim 1, wherein the beating stages of the line of beating alternate with grading chambers.

7. The method according to claim 6, wherein the portions of lamina leaving the grading chambers are subjected to a drying treatment before transfer to the packaging process.

8. The method according to claim 1, wherein the rib portions coming out of said beating line are subjected to a drying treatment before transfer to the packaging process.

9. The method according to claim 1, wherein before introducing the tobacco leaves to be treated in said shredder, said leaves are subjected to a conditioning treatment to bring a moisture content of the leaves to an optimal value for subsequent treatments.

* * * * *